US006880958B2

(12) United States Patent
Swarovski

(10) Patent No.: US 6,880,958 B2
(45) Date of Patent: Apr. 19, 2005

(54) ELECTRIC LIGHTING DEVICE IN THE FORM OF A CANDLE

(75) Inventor: Helmut Swarovski, Fritzens (AT)

(73) Assignee: D. Swarovski & Co., Wattens (AT)

( * ) Notice: Subject to any disclaimer, the term of this patent is extended or adjusted under 35 U.S.C. 154(b) by 0 days.

(21) Appl. No.: 10/388,507

(22) Filed: Mar. 17, 2003

(65) Prior Publication Data

US 2003/0179581 A1 Sep. 25, 2003

(30) Foreign Application Priority Data

Mar. 19, 2002 (AT) ..... A 413/2002

(51) Int. Cl.[7] ..... F21V 35/00

(52) U.S. Cl. ..... 362/392; 362/191; 362/393; 362/810

(58) Field of Search ..... 362/191, 806, 362/810, 569, 392, 393, 396, 186

(56) References Cited

U.S. PATENT DOCUMENTS

| | | | | | |
|---|---|---|---|---|---|
| 1,954,756 | A | * | 4/1934 | Kindston et al. | 362/392 |
| 2,053,139 | A | * | 9/1936 | Donovan et al. | 362/392 |
| 2,077,107 | A | * | 4/1937 | Grundman | 362/392 |
| 2,710,912 | A | * | 6/1955 | Holm | 362/392 |
| 2,782,296 | A | * | 2/1957 | Walter | 362/392 |
| 4,187,532 | A | * | 2/1980 | Naffier | 362/186 |
| 4,866,580 | A | * | 9/1989 | Blackerby | 362/205 |
| 5,664,879 | A | * | 9/1997 | Lai | 362/392 |
| 5,863,108 | A | | 1/1999 | Lederer | 362/186 |
| 6,241,362 | B1 | * | 6/2001 | Morrison | 362/231 |
| 6,595,676 | B1 | * | 7/2003 | Starry | 362/569 |

* cited by examiner

*Primary Examiner*—John Anthony Ward
(74) *Attorney, Agent, or Firm*—Wenderoth, Lind & Ponack, L.L.P.

(57) ABSTRACT

An electric lighting device is in the form of a candle, in particular a Christmas tree candle. It has at least one light source and a mechanical holding device for detachable attachment to a support, in particular a tree branch. The electric lighting device includes a candle stem and a lighting section in the style of, in particular, a flame. The candle stem (4) and the lighting section (5) consist of a transparent material which is preferably polished in a facetted manner.

17 Claims, 2 Drawing Sheets

ELECTRIC LIGHTING DEVICE IN THE FORM OF A CANDLE

BACKGROUND OF THE INVENTION

The present invention relates to an electric lighting device in the form of a candle, in particular a Christmas tree candle with at least one light source and a mechanical holding device for detachable attachment to a support, in particular a tree branch. The electric lighting device comprises a candle stem and a lighting section in the style of, in particular, a flame.

For many people the festive decoration of the home at Christmas time and above all the dressing of the Christmas tree on Christmas eve is not just a much-loved tradition, but also represents for them a possibility of mental preparation for Christmas. Candles are naturally indispensable for a festive decoration of the Christmas tree. However, naked flames represent a great safety risk above all for children, for which reason people are increasingly switching to the use of artificial Christmas tree lighting. This explains the great variety of already known electric Christmas tree candles.

DE 197 34 345 A1 and DE 9 320 336 U1 disclose for example an electric candle light, wherein on the top side of a candle stem housing a battery in a transparent casing based on a flame, a light source is attached in the form of a light-emitting diode. DE 198 14 231 A1 also describes an electric light in the form of a candle, wherein on the top side of the opaque candle stem, a light source is attached in a transparent casing. The problem in this context is that Christmas tree candles made of plastic are not accepted by many people as a substitute for the more festive wax candles.

SUMMARY OF THE INVENTION

The object of the invention is to create an electric lighting device in the form of a candle which is simple in terms of design and is optically attractive.

This is achieved according to the invention in that the candle stem and the lighting section consist of a transparent material which is preferably polished in facetted manner.

A technical advantage of this invention is the possibility of arranging the light source not above the candle stem, but for example in the area of the mechanical holding device, which simplifies the power supply in technical terms. An economical advantage of this invention is the possibility of designing both the lighting section and the candle stem in an optically attractive manner, which increases acceptance among customers.

An advantageous version of the invention follows from the fact that glass is used as transparent material. This makes a large variety of variants possible through the use of colored glass with comparatively low production costs. Gemstones could of course also be used as transparent material, but this results in an increased selling price.

A further advantageous variant of the invention follows from the fact that the candle stem can be detachably inserted into the mechanical holding device. This makes possible an easy removal of the glass bodies for cleaning purposes and the convenient replacement of for example button batteries fitted in the mechanical holding device.

A further advantageous version of the invention follows from the fact that power is supplied to the light sources via batteries or accumulators arranged in the electric lighting device. The fitting of the batteries in the mechanical holding device avoids the need for optically less attractive cables.

As many people could feel the replacement of spent batteries to be tiresome, it can be provided in a further advantageous version of the invention that power is supplied to the light sources externally via leads.

A further advantageous version of the invention follows from the fact that a light-emitting diode (LED) is chosen as a light source. This combines a compact construction and a great luminosity with low current consumption.

A further advantageous version of the invention follows from the fact that the mechanical holding device comprises a spring-loaded clamp, which in itself is naturally state of the art. This makes possible the quick placing of the electric lighting device on a tree branch.

A further advantageous version of the invention follows from the fact that the light sources are attached to the mechanical holding device. Thus only the mechanical holding device, and not the entire electric lighting device, has to be replaced in the case of a defective light source.

A further advantageous variant of the invention consists of an electric lighting device in the form of a candle, in particular a Christmas tree candle with at least one light source and a mechanical holding device for detachable attachment to a support, in particular a tree branch, the electric lighting device comprising a candle stem and a lighting section in the style of, in particular, a flame. The light source(s) being arranged—preferably exclusively—underneath the candle stem and preferably lying against. The light emitted from the light source(s) extends at least in part over the candle stem into the lighting section lying above it. Because the light sources themselves are not visible from the outside in, an optically attractive, indirect illumination of the Christmas tree candle takes place.

A further advantageous version of the invention follows from the fact that light is supplied to the lighting section exclusively through the candle stem. The light entering the candle stem from below is guided for example via total reflection into the upper lighting section, where it finally emerges from the material. This limits the light emission to a limited area of the lighting section (lighting zone), which produces an extremely optically attractive effect. This is particularly advantageously carried out in that the lighting section is conically tapered to a tip at the top. The candle stem could of course also be at least partly covered with a reflecting layer.

It would also of course be possible to arrange a light source in a bore located on the candle stem, power being supplied to the light source by conductor lines deposited onto the candle stem.

A further advantageous form of the invention follows from the fact that the lighting section is developed as a separate part in the shape of a flame and attached to the candle stem, for example glued on. This makes possible a separate manufacture of the two parts.

A further advantageous version of the invention follows from the fact that the candle stem and the lighting section are developed in one piece. Particularly advantageous design possibilities thereby result.

A further advantageous version of the invention follows from the fact that a power supply is provided which triggers the light source(s) such that these emit a flickering light. The imitation of the natural flickering of a candle flame increases acceptance of the electric Christmas tree candles among customers.

Further details and advantages of the invention are described in more detail in the following using FIGS. 1 to 4 by way of example.

BRIEF DESCRIPTION OF THE DRAWINGS

There is shown in.

DETAILED DESCRIPTION OF THE PREFERRED EMBODIMENTS

Figure 1:
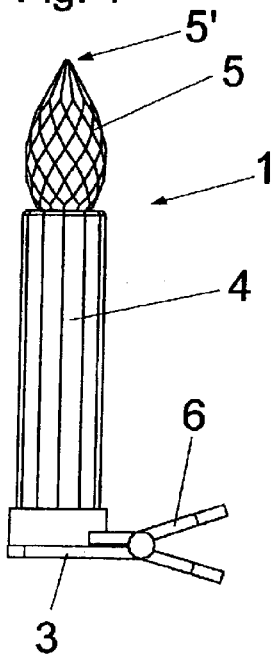
FIG. 1 an embodiment of a lighting device according to the invention in side view.

FIG. 1 shows an electric lighting device in the form of a candle 1, the lighting section 5 being developed as a separate part in the form of a flame and attached to a candle stem 4. The upper part of the lighting section 5 is conically tapered to a tip 5'. The mechanical holding device 3 comprises a spring-loaded clamp 6 through which the electric lighting device can be attached for example to a tree branch.

Figure 2:
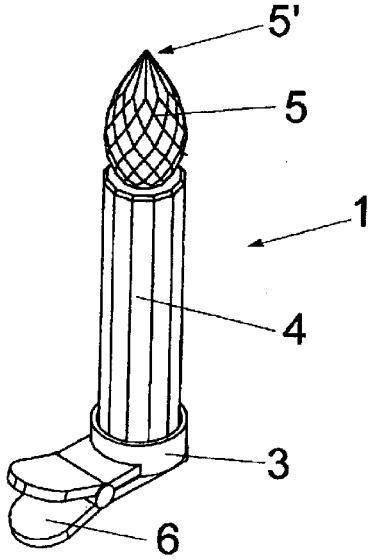
FIG. 2 this lighting device in perspective view.

FIG. 2 shows the same lighting device in perspective view.

Figure 3:
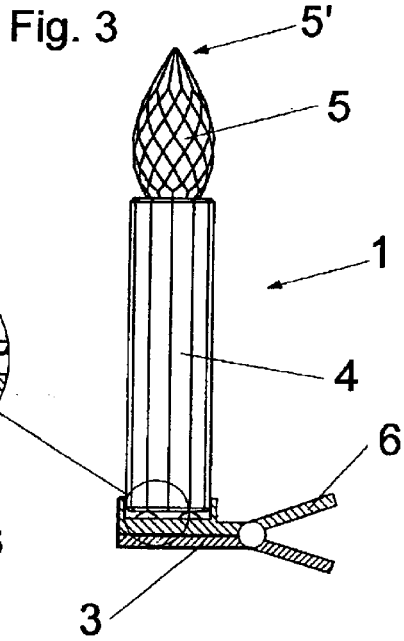
FIGS. 3, 3*a*, and 3*b* a section through the mechanical holding device with fitted candle stem, a detail of the candle stem lying on the light sources and a perspective view of the mechanical holding device without the fitted candle stem and FIG. 4 a side view of an electric lighting device developed in one piece.
Figure 3A:
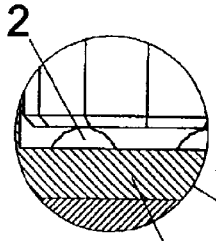
Figure 3B:
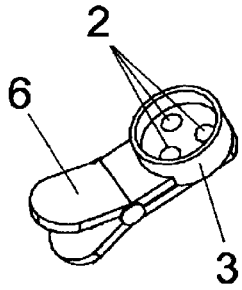

FIG. 3 shows light sources 2 arranged in the mechanical holding device 3, here in the form of light-emitting diodes. The detail (FIG. 3*a*) shows that the candle stem 4 is inserted into the mechanical holding device 3 such that it lies on the light sources 2 located below it. The light emitted from the light sources 2 can thereby optimally enter the candle stem 4 and in this embodiment is guided by total reflection into the lighting section 5 developed as a flame. As the lighting section 5 is tapered conically to a tip 5' at the top, the geometric conditions for a total reflection do not obtain there, which is why the light preferably emerges from the material in this area. An aesthetically extremely attractive bright light, limited to this area, thus forms. In FIG. 3*b* the mechanical holding device 3 can be seen in perspective view without a fitted candle stem. In this embodiment, three light sources 2 in the form of light-emitting diodes can be seen in the mechanical holding device 3.

Figure 4:
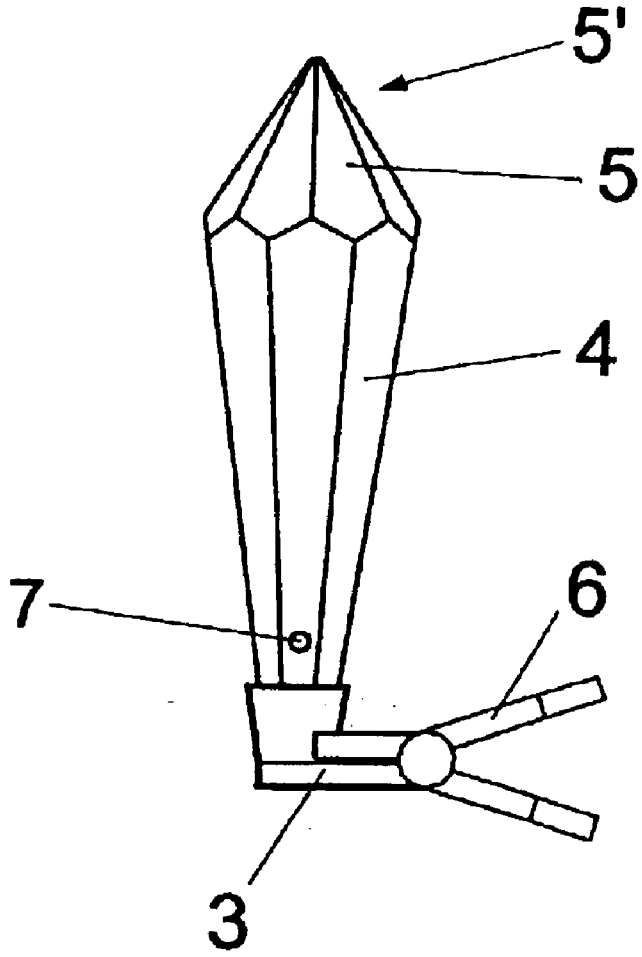

FIG. 4 shows an electric lighting device according to the invention in which the candle stem 4 and the lighting section 5 are developed in one piece. A bore 7 into which a light-emitting diode can be introduced, can also be seen.

In all the figures, for reasons of clarity, the batteries supplying the light sources, or cables in the case of an external power supply have not been shown.

What is claimed is:

1. An electric lighting device in the form of a candle, comprising:

a mechanical holding device for detachable attachment to a support;

a candle stem made of transparent material mounted with said mechanical holding device and a lighting section in the style of a flame on said candle stem, said lighting section also being made of transparent material; and at least one light source to supply light to said lighting section;

wherein said at least one light source is mounted underneath said candle stem and said light from said at least one light source travels through said transparent material of said candle stem from said at least one light source and into said transparent material of said lighting section above said candle stem.

2. The electric lighting device of claim 1, wherein said candle stem and said lighting section consist of said transparent material.

3. The electric lighting device of claim 1, wherein said transparent material is glass.

4. The electric lighting device of claim 1, wherein said candle stem is detachably attached to said mechanical holding device.

5. The electric lighting device of claim 1, wherein said lighting section is at least partly made of colored material.

6. The electric lighting device of claim 1, wherein said candle stem and said lighting section are made as one piece.

7. The electric lighting device of claim 1, wherein said lighting section is made as a separate part in the form of a flame and attached to said candle stem.

8. The electric lighting device of claim 1, wherein said lighting section is conically tapered to a tip at a top thereof.

9. The electric lighting device of claim 1, wherein said mechanical holding device comprises a spring-loaded clamp.

10. The electric lighting device of claim 1, wherein said at least one light source comprises a light-emitting diode.

11. The electric lighting device of claim 1, wherein said at least one light source is connected to an external power source by conductor lines.

12. The electric lighting device of claim 1, wherein said at least one light source is connected to at least one battery or accumulator as a power source.

13. The electric lighting device of claim 1, wherein said at least one light source is attached to said mechanical holding device.

14. The electric lighting device of claim 1, and further comprising a power supply for said at least one light source operable to trigger said at least one light source to emit a flickering light.

15. The electric lighting device of claim 1, wherein said device is in the form of a Christmas tree candle and said mechanical holding device is detachably attachable to a tree branch.

16. The electric lighting device of claim 1, wherein at least one of said candle stem and said lighting section comprises a faceted surface.

17. The electric lighting device of claim 1, wherein said at least one light source is located in said mechanical holding device and said candle stem is positioned in said mechanical holding device with a bottom surface facing said at least one light source so that light from said at least one light source can travel through said transparent material of said candle stem to said transparent material of said candle stem.

* * * * *